US006581852B2

(12) United States Patent
Garcia et al.

(10) Patent No.: US 6,581,852 B2
(45) Date of Patent: Jun. 24, 2003

(54) FLUID DISPENSER

(75) Inventors: Firmin Garcia, Evreux (FR); Jean-Jacques Ligny, Evreux (FR)

(73) Assignee: Valois S. A., Le Neubourg (FR)

( * ) Notice: Subject to any disclaimer, the term of this patent is extended or adjusted under 35 U.S.C. 154(b) by 0 days.

(21) Appl. No.: 10/004,843

(22) Filed: Dec. 7, 2001

(65) Prior Publication Data

US 2002/0070239 A1 Jun. 13, 2002

(30) Foreign Application Priority Data

Dec. 8, 2000 (FR) ..... 00 15995

(51) Int. Cl.[7] ..... B05B 9/00; B05B 11/04

(52) U.S. Cl. ..... 239/326; 239/327; 239/328; 239/102.1; 239/102.2

(58) Field of Search ..... 239/102.1, 102.2, 239/326, 327, 328; 222/630, 631, 632, 633, 95, 107, 105, 161, 202, 203, 196, 187

(56) References Cited

U.S. PATENT DOCUMENTS

| | | | | | |
|---|---|---|---|---|---|
| 2,207,294 | A | * | 7/1940 | Hübner et al. | 239/327 |
| 3,010,613 | A | | 11/1961 | Stossel | |
| 3,422,993 | A | | 1/1969 | Boehm et al. | |
| 3,897,005 | A | * | 7/1975 | Reiner | 239/327 |
| 3,913,789 | A | * | 10/1975 | Miller | 222/107 |
| 3,917,116 | A | * | 11/1975 | Mason | 222/107 |
| 4,018,364 | A | | 4/1977 | Wright | |
| 4,381,846 | A | * | 5/1983 | Heck | 222/105 |
| 4,730,751 | A | * | 3/1988 | Mackles et al. | 239/327 |
| 4,836,422 | A | | 6/1989 | Rosenberg | |
| 5,139,168 | A | * | 8/1992 | Gueret | 222/92 |
| 5,529,055 | A | | 6/1996 | Gueret | |
| 5,823,428 | A | * | 10/1998 | Humberstone et al. | 239/102.2 |
| 5,838,350 | A | | 11/1998 | Newcombe et al. | |
| 6,021,930 | A | * | 2/2000 | de Pous et al. | 222/209 |
| 6,264,065 | B1 | * | 7/2001 | Jouillat | 239/327 |
| 6,378,780 | B1 | * | 4/2002 | Martens et al. | 239/102.2 |
| 6,386,462 | B1 | * | 5/2002 | Martens, III | 239/102.2 |

FOREIGN PATENT DOCUMENTS

| | | |
|---|---|---|
| EP | 0 897 755 A2 | 2/1999 |
| WO | WO 00/51747 | 9/2000 |
| WO | WO 00/59335 | 10/2000 |

* cited by examiner

*Primary Examiner*—Robin O. Evans
(74) *Attorney, Agent, or Firm*—Sughrue Mion, PLLC

(57) ABSTRACT

A fluid dispenser, including a fluid reservoir formed with an opening, the reservoir including a deformable flexible pouch in which the fluid is stored at a pressure substantially equal to or slightly lower than atmospheric pressure; a fluid dispensing system including a dispensing outlet; and a feed duct connecting the opening of the reservoir to the dispensing system; and wherein the flexible pouch contains a piece of porous material.

4 Claims, 1 Drawing Sheet

FLUID DISPENSER

The present invention relates to a fluid dispenser comprising: a fluid reservoir formed with an opening; a fluid dispensing system; and a feed duct connecting the opening of the reservoir to the dispensing system.

BACKGROUND OF THE INVENTION

Numerous documents are already known that describe fluid dispensers using vibrating membranes to dispense fluid. For example, mention might be made of Documents EP 0 682 570, EP 0 615 470, and EP 0 696 234. In those three documents, the dispensing system used comprises a perforated membrane that is subjected to sustained vibration, e.g. generated by a piezoelectric element. Fluid is in contact with one of the faces of the perforated membrane, and the perforated membrane being caused to vibrate causes the fluid to pass through the holes in the perforated membrane so as to be dispersed in the form of fine droplets of fluid. It is advantageous for the fluid present at the face of the membrane to be at a pressure substantially equal to or slightly lower than atmospheric pressure. In Document EP 0 682 570, the fluid is drip fed to the perforated membrane. Therefore, it is indeed at atmospheric pressure. In Documents EP 0 615 470 and EP 0 696 234, the fluid is fed to the perforated membrane by means of a capillary action feed that is immersed in a reservoir of fluid. To ensure that such feeding by capillary action functions properly, it is essential for the fluid in the reservoir to be stored at a pressure substantially equal to or slightly lower than atmospheric pressure. That problem is not addressed in the two above-mentioned documents.

Document U.S. Pat. No. 5,838,350 even describes a membrane dispenser in which the reservoir is a flexible pouch. However, the deformation of the pouch as the fluid is extracted therefrom generates pressure variations at the membrane.

OBJECTS AND SUMMARY OF THE INVENTION

The present invention proposes to remedy the above-mentioned problem by defining a fluid dispenser advantageously but not exclusively having a vibrating membrane, and in which the reservoir is specially adapted to the fluid being fed at a constant pressure that is substantially equal to or slightly lower than atmospheric pressure.

To this end, the present invention provides a fluid dispenser comprising: a fluid reservoir formed with an opening, the reservoir comprising a deformable flexible pouch in which the fluid is stored at a pressure substantially equal to or slightly lower than atmospheric pressure; a fluid dispensing system including a dispensing outlet; and a feed duct connecting the opening of the reservoir to the dispensing system; wherein the flexible pouch contains a piece of porous material.

The piece of porous material serves to further improve the constancy of the pressure inside the reservoir. It serves as a damping buffer while fluid is being dispensed through the membrane and after it has been dispensed, each time fluid is dispensed. The flexible pouch preferably has no shape memory, nor any significant resistance to deformation, so that its capacity can be modified without significantly varying the pressure inside the pouch. This is not the case with a rigid flask having an air intake, because air then penetrates into the reservoir only at the end of dispensing of the fluid, and therefore suction is generated inside the reservoir.

Neither is this the case with a follower piston system that requires significant suction inside the reservoir to enable the follower piston to be returned by suction. All of these problems of pressure variation inside the reservoir are eliminated with a flexible pouch that is freely deformable and in which a piece of porous material is received. At best, each time the flexible pouch is deformed, very slight suction is generated inside the flexible pouch, which is a desired condition to enable a vibrating membrane dispensing system to function properly. It is preferable for the fluid to be subjected to slight suction at the membrane in order to guarantee spraying that is of good quality.

The present invention can be summed up as the synergistic combination of a freely-deformable flexible pouch and of a piece of porous material for containing the fluid to be dispensed, advantageously with a dispensing system having a perforated vibrating membrane.

In addition, the use of a flexible pouch enables the fluid it contains to be preserved well because it is never in contact with the air.

Advantageously, the reservoir further comprises a flexible pouch support to which the pouch is bonded, the opening of the reservoir being formed by said pouch support, and the piece of porous material being secured to said pouch support. In practical manner, the piece of porous material may include a connection end piece engaged in the opening of the pouch support. Preferably, the piece of porous material obstructs the opening. Thus, there is no direct communication between the fluid situated in the empty space inside the flexible pouch and the feed duct. On the contrary, the fluid is constrained to pass through the piece of porous material in order to reach the feed duct. The piece of porous material also makes it possible to guarantee that fluid is present at the opening of the reservoir. Thus, the feed duct is permanently in communication with the fluid. Advantageously, the feed duct is connected to the opening. Preferably, the feed duct obstructs the opening. Thus, the feed duct is connected directly to the piece of porous material, and the fluid inside the fluid-soaked porous material can go directly into the feed duct. Advantageously, the feed duct contains an element made of porous material for conveying the fluid by capillary action from the reservoir to the dispensing system. Thus, there is no discontinuity in the porous material between the reservoir containing the piece of porous material and the feed duct containing the element made of porous material. Thus, it is possible to guarantee permanent and constant feeding with slight suction generated by the deformable flexible pouch.

In a visually attractive embodiment, the dispensing system and the feed duct are mounted in a shell made up of two pieces, advantageously leaving a portion of the reservoir visible.

In a preferred embodiment, the dispensing system comprises a vibrating membrane perforated with holes through which the fluid is dispensed in the form of fine droplets. In which case, the dispensing system may be substantially analogous to the systems described in the above-mentioned prior art documents.

BRIEF DESCRIPTION OF THE DRAWING

The invention is described more fully below with reference to the accompanying drawing giving an embodiment of the invention by way of non-limiting example.

In the drawing.

MORE DETAILED DESCRIPTION

Figure 1:
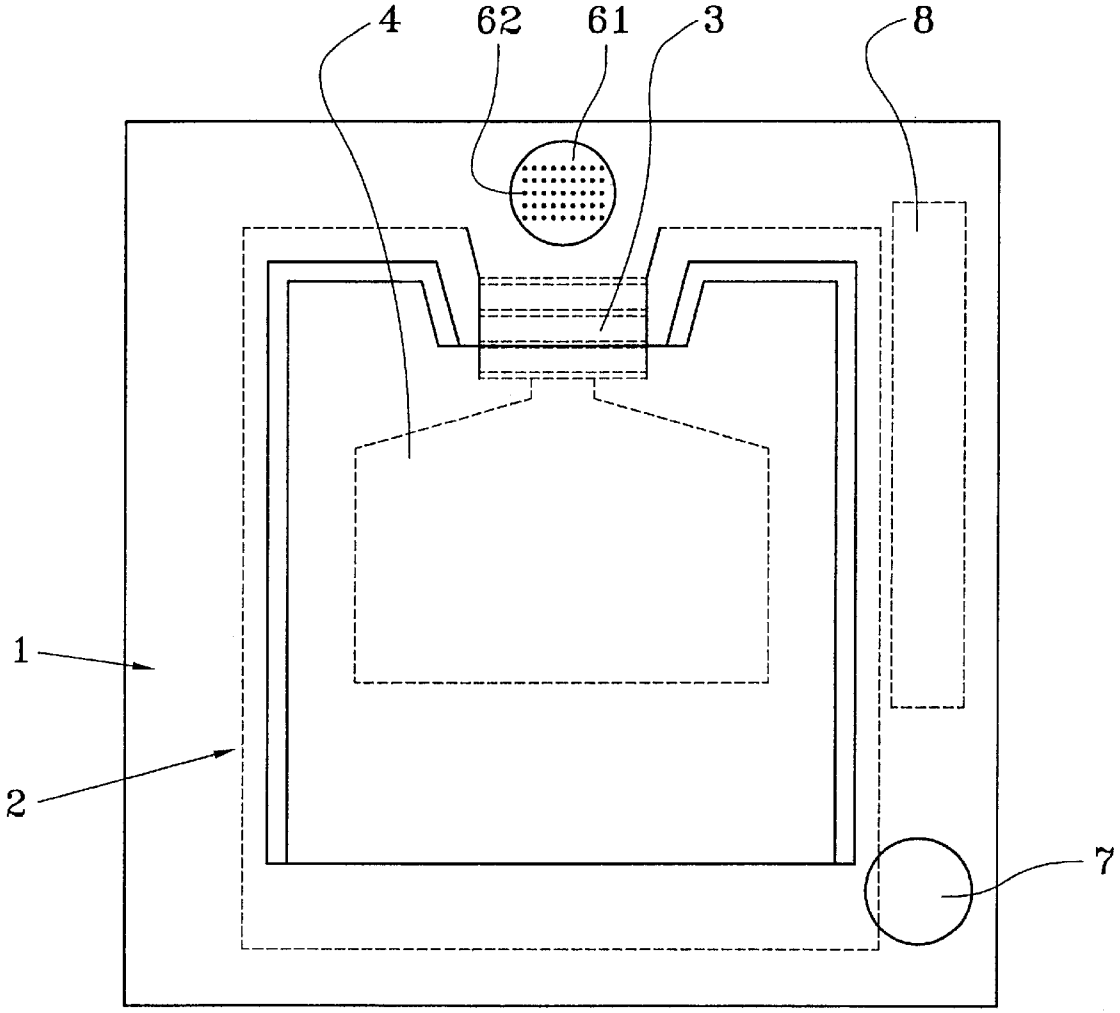
FIG. 1 is a partially transparent diagrammatic face view of a fluid dispenser of the invention.
Figure 2:
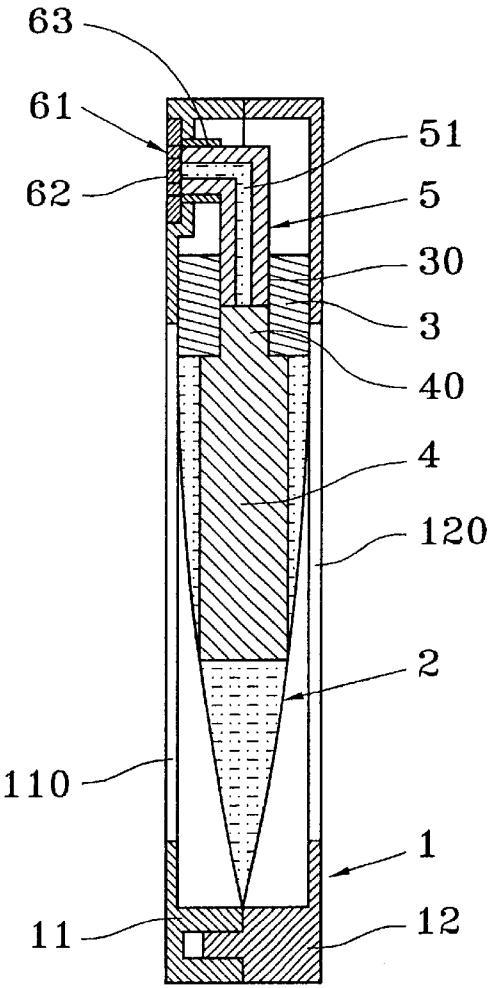
FIG. 2 is a vertical section view through the dispenser of FIG. 1.

The fluid dispenser of the invention includes a fluid dispensing system comprising a vibrating membrane 61 that can be caused to vibrate by vibration means 63, e.g. an piezoelectric element. The electronics and the power supply required for the piezoelectric element 63 to operate properly are represented by the block 8 shown in FIG. 1. The particular type of means used to cause the membrane 6 to vibrate is not a critical or essential parameter of the present invention. It is important merely for the dispensing system to incorporate a vibrating membrane in at least temporary contact with the fluid. In the embodiment described, the vibrating membrane 61 is perforated with an array of holes 62.

In addition, the fluid dispenser of the invention includes a reservoir 2 serving to contain the fluid to be dispensed by the above-described dispensing system. More precisely, the fluid contained in the reservoir 2 serves to be dispensed through the holes 62 in the vibrating membrane 61 in the form of fine droplets of fluid.

In the invention, the reservoir 2 is a freely-deformable flexible pouch, e.g. made up of one or two sheets of composite film bonded together around their peripheries, except at an opening in which a pouch support 3 is engaged in leaktight manner. In general, the opening in the pouch 2 is bonded to the pouch support 3. The pouch support 3 defines an opening 30 through which the fluid contained in the reservoir 2 can be extracted. The walls of the flexible pouch 2 may be deformed with little resistance so that the fluid stored inside the pouch remains at an almost constant pressure that is equal to or slightly lower than atmospheric pressure. It is easy to understand that the flexible pouch being deformed so that its capacity is reduced does generate some resistance to deformation, resulting in slight suction being generated inside it.

The use of a deformable pouch having a shape memory, such as a resilient pouch, would not be appropriate.

The vibrating membrane 61 is connected to the flexible pouch 2 via a feed duct 5. The duct 5 is connected directly to the opening 30 in the pouch support 3. At its other end, the feed duct 5 extends to the inside face of the vibrating perforated membrane 61. To ensure that fluid is present at the inside face of the vibrating perforated membrane 61, the feed duct 5 contains an element made of porous material 51 that acts as means for conveying fluid by capillary action from the reservoir 2. The element made of porous material 51 may extend into the reservoir 2 so as to be immersed directly in the fluid so as to be soaked with it. However, according to a characteristic of the invention, the flexible pouch 2 contains a piece of porous material 4 suitable for becoming soaked with fluid by capillary action. The piece of porous material 4 occupies a non-negligible volume of the flexible pouch 2, and thus makes it possible to soak up the fluid stored anywhere in the pouch. Advantageously, the piece of porous material 4 is secured to the pouch support 3, e.g. by a connection end-piece 40 formed by the piece of porous material 4 being engaged into the opening 30 formed by the pouch support 3. The piece of porous material 4 may even obstruct the opening 30, so that the fluid stored freely in the flexible pouch 2 cannot flow out directly through the opening 30, but rather it is constrained to pass through the piece of porous material 4. Similarly, the feed duct 5 may be engaged in the opening 30 so as to obstruct it. Thus, via its opening 30, the pouch support 3 acts as a leaktight connection sleeve between the feed duct 5 and the piece of porous material 4. Preferably, the element made of porous material 51 contained in the feed duct 5 extends as far as to come into contact with the piece of porous material 4 engaged in the opening 30. Thus, a continuous feed path is formed for the fluid from the flexible pouch 2 to the inside face of the perforated vibrating membrane 61.

The piece of porous material 4 offers several advantages. Firstly, it makes it possible to feed the feed duct 55 with fluid. Secondly, it acts as a buffer for damping any variations in pressure inside the flexible pouch 2. Thirdly, it makes it possible to empty almost all of the flexible pouch 2 because the fluid tends to soak into the porous material rather than remaining next to it in the empty space provided by the flexible pouch.

The fluid dispensing system and the flexible pouch 2, its pouch support 3, and the feed duct 5 may be received inside a shell 1, which may advantageously be made in two assemblable pieces. The two pieces 11 and 12 may be almost symmetrical. However, one of the shell pieces 11 must be provided with one recess for receiving the perforated membrane 61 and with another recess for receiving an actuating button 7. The two shell pieces may advantageously be provided with respective windows 110, 120 through which the flexible pouch 2 is visible. The assembled shell 1 may serve as a housing for receiving the power supply and electronics unit 8 for the vibration means 63.

In the embodiment used to illustrate the present invention, the dispensing system comprises a vibrating membrane. However, the flexible pouch with its piece of porous material inside it may be used with forms of dispensing systems other than a vibrating membrane, such as a pump.

What is claimed is:

1. A fluid dispenser comprising:

a fluid reservoir formed with an opening, the reservoir comprising a freely-deformable flexible pouch having no shape memory, so that the capacity thereof can be modified without significantly varying the pressure inside the pouch, the fluid being stored in the pouch at a pressure substantially equal to or slightly lower than atmospheric pressure;

a fluid dispensing system including a dispensing outlet; and a feed duct connecting the opening of the reservoir to the dispensing system;

wherein the flexible pouch contains a piece of porous material; and in which the feed duct contains an element made of porous material for conveying the fluid by capillary action from the reservoir to the dispensing system.

2. A fluid dispenser comprising:

a fluid reservoir formed with an opening, the reservoir comprising a freely-deformable flexible pouch having no shape memory, so that the capacity thereof can be modified without significantly varying the pressure inside the pouch, the fluid being stored in the pouch at a pressure substantially equal to or slightly lower than atmospheric pressure;

a fluid dispensing system including a dispensing outlet; and a feed duct connecting the opening of the reservoir to the dispensing system;

wherein the flexible pouch contains a piece of porous material; and in which the dispensing system comprises a vibrating membrane perforated with holes through which the fluid is dispensed in the form of fine droplets.

3. A dispenser according to claim 2, in which the piece of porous material is in contact with the vibrating membrane.

4. A fluid dispenser comprising:

a fluid reservoir formed with an opening, the reservoir comprising a freely-deformable flexible pouch having no shape memory, so that the capacity thereof can be modified without significantly varying the pressure inside the pouch, the fluid being stored in the pouch at a pressure substantially equal to or slightly lower than atmospheric pressure;

a fluid dispensing system including a dispensing outlet; and a feed duct connecting the opening of the reservoir to the dispensing system;

wherein the flexible pouch contains a piece of porous material; and in which the feed duct is connected to the opening; and in which the feed duct includes additional porous material that obstructs the opening.

* * * * *